United States Patent [19]

Ise et al.

[11] Patent Number: 4,848,392

[45] Date of Patent: Jul. 18, 1989

[54] SOLENOID ON-OFF VALVE

[75] Inventors: Yoji Ise; Akira Yamaguchi, both of Tokyo, Japan

[73] Assignee: Myotoku Ltd., Tokyo, Japan

[21] Appl. No.: 199,070

[22] Filed: May 26, 1988

[30] Foreign Application Priority Data

May 30, 1987 [JP] Japan ..... 62-84874[U]

[51] Int. Cl.[4] ..... F16K 31/02

[52] U.S. Cl. ..... 137/270; 251/129.21; 137/270.5

[58] Field of Search ..... 137/270, 270.5, 596; 251/129.21

[56] References Cited

U.S. PATENT DOCUMENTS 2,966,168 12/1960 Hunt ..... 137/270

3,026,896 3/1962 Bosworth ..... 137/270

4,336,823 6/1982 Staiger ..... 137/270

*Primary Examiner*—Alan Cohan

*Attorney, Agent, or Firm*—Biebel, French & Nauman

[57] ABSTRACT

A solenoid on-off valve for opening or closing a flow channel passing through a valve chamber by alternately moving a plunger in the valve chamber with a solenoid and a return spring, comprises valve seats on both ends of the valve chamber, a valve head 12 for closing valve seats is disposed at one end, while a path 14 for communicating the valve hole of the valve seat with the valve chamber is disposed at the other end of the plunger and the flow channel is adapted so as to be normally open or normally closed by the mounting of the plunger in the valve chamber while turning the direction depending on the case.

1 Claim, 4 Drawing Sheets

SOLENOID ON-OFF VALVE

BACKGROUND OF THE INVENTION

Field of the invention

The present invention concerns a solenoid on-off valve used for opening or closing a flow channel. A solenoid on-off valve is adapted to alternately displace a plunger in a valve chamber by a solenoid and a return spring to open or close the flow channel passing through the valve chamber. However, for attaining a normally open state in which the valve is kept at an open position and a normally closed state in which the valve is kept at a closed position by the return spring, the valve structure has to be modified so as to adaptable to the respective cases, which has been inconvenient and not economical as well.

SUMMARY OF THE INVENTION

Object of the invention

The object of the present invention is to provide a solenoid on-off valve capable of easily attaining a normally open state and a normally closed state switchingly by a simple structure.

The foregoing object of the present invention can be attained by a solenoid on-off valve for opening or closing a flow channel passing through a valve chamber by alternately displacing a plunger in the valve chamber by a solenoid and a return spring, wherein valve seats are disposed at both ends of the valve chamber, a valve head for closing the valve seats is disposed to one end and a passage for communicating the valve hole of the valve seat with the valve chamber is disposed to the other end of the plunger, and the plunger is mounted in the valve chamber while turning their ends occasionally, thereby enabling to switch the flow channel between a normally open state or a normally closed state.

DESCRIPTION OF THE ACCOMPANYING DRAWINGS

These and other objects, as well as advantageous features of the present invention will become apparent by reading the following descriptions for preferred embodiments of the present invention in conjunction with the accompanying drawings, wherein FIG. 1 is an exploded perspective view;

DESCRIPTION OF THE PREFERRED EMBODIMENTS

The present invention will be described specifically to a preferred embodiment of the solenoid on-off valve according to the present invention applied to the solenoid valve main body for generating vacuum and a solenoid valve main body for cancelling vacuum of a vacuum attraction apparatus in conjunction with the accompanying drawings.

Figure 1:
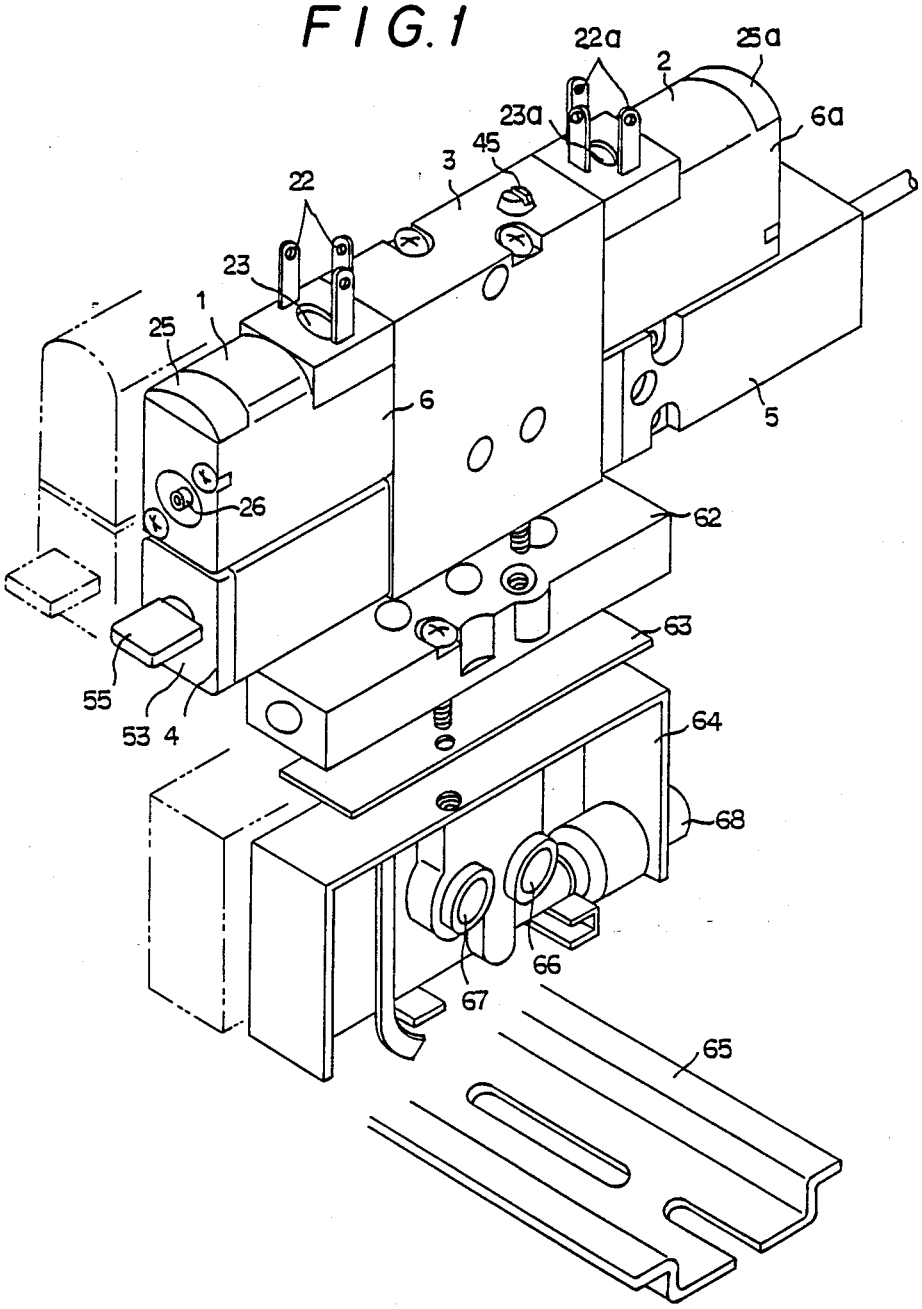

As shown in FIG. 1, a vacuum generating solenoid valve main body 1 and a vacuum cancelling solenoid valve main body 2 are attached on both sides at the upper portion of ejector type vacuum pump main body 3 and a filter main body 4 and a vacuum switch 5 are attached on both sides at the lower portion of the pump main body.

Figure 2:
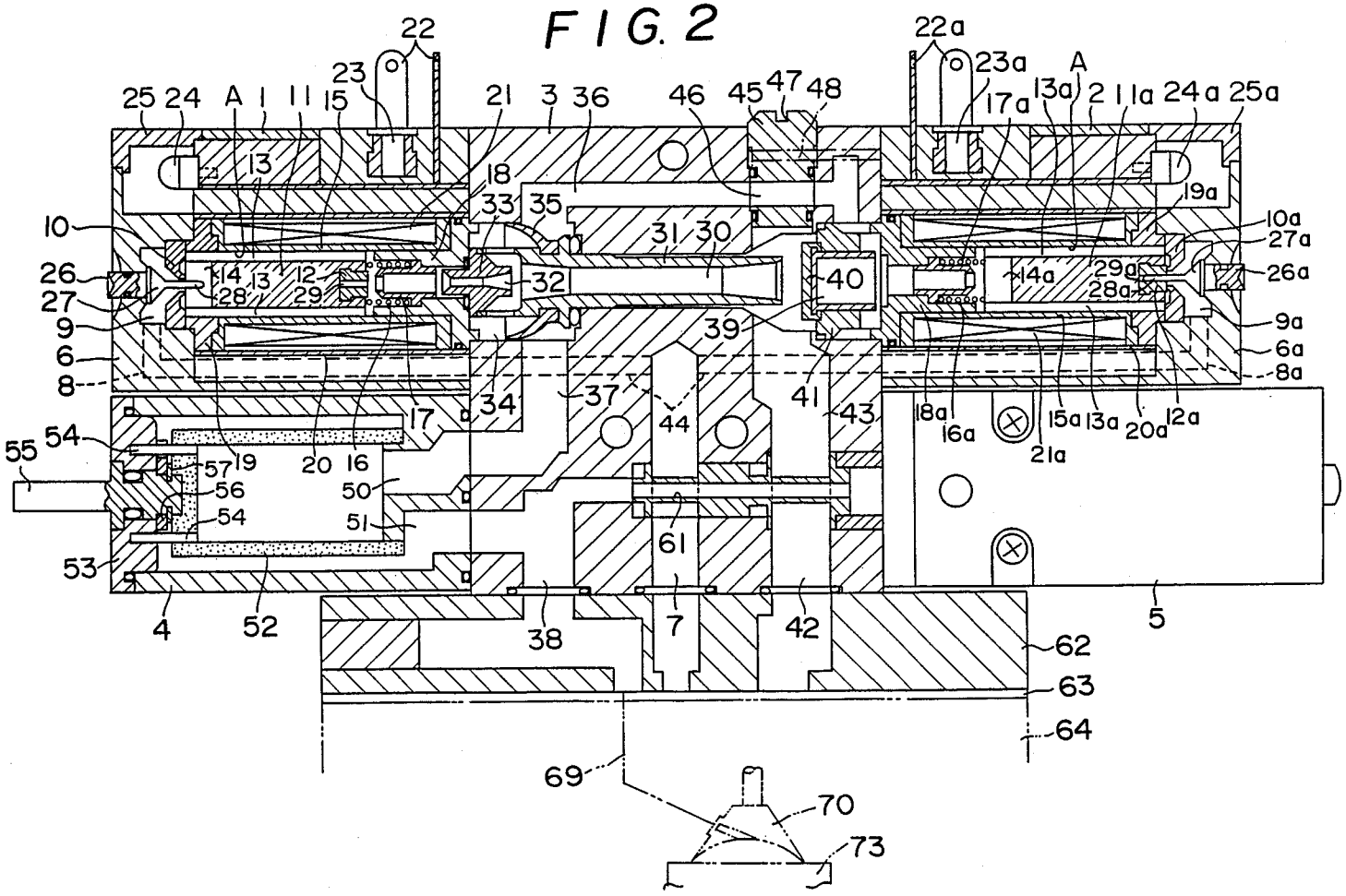
FIG. 2 is an enlarged front elevational vertical cross sectional view of the embodiment.
Figure 3:
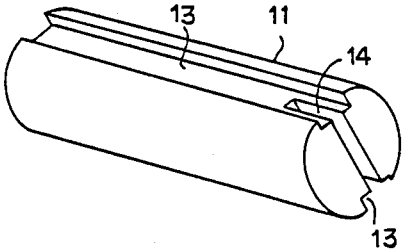
FIG. 3 and FIG. 4 are perspective views illustrating respective end faces of a plunger.
Figure 4:
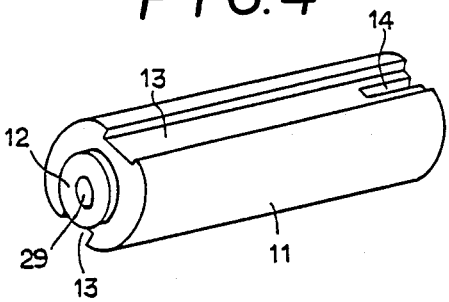

The vacuum generating solenoid valve main body 1 and the vacuum cancelling solenoid valve main body 2 are of an identical structure excepting that the direction of mounting the plunger is opposite to each other as described later. That is, as shown in FIG. 2, respective cases 6, 6*a* for the solenoid valve main bodies 1, 2 are formed with pass holes 8, 8*a* in communication with the pressurized air inlet 7 at the lower surface of the pump main body 3 by way of a pass hole 44, and the pass holes 8, 8*a* are opened to inflow chambers 9, 9*a* respectively. Valve seats 10, 10*a* are disposed to the inflow chambers 9, 9*a* respectively and plungers 11, 11*a* fitted in the valve chambers A, A are opposed to the valve seats 10, 10*a*. The plungers 11, 11*a* have a valve head 12, 12*a* made of resilient synthetic resin, etc. at one ends thereof, long grooves 13, 13 and 13*a*, 13*a* are formed extended in the longitudinal direction on the circumferential surface, and vertical path 14, 14*a* of groove form for communicating the long grooves are formed at the other end of the plungers 11, 11*a* (refer to FIG. 3 and FIG. 4). The plungers 11, 11*a* are slidably fitted in the valve chambers A, A formed with the cylindrical portions of bobbins 15, 15*a* and they can be contained while being turned in their direction. They are resiliently biased by return springs 16, 16*a* in the direction opposite to the moving direction by the energization described later, that is, in the direction abutting against the valve seats 10, 10*a* respectively in the drawings.

That is, the plunger 11 of the vacuum generating solenoid valve main body 1 is resiliently biased in the direction that the surface with the path 14 abuts against the valve seat 10, while the plunger 11*a* of the vacuum cancelling solenoid valve main body 2 is biased in the direction that the valve head 12*a* abuts against the valve seat 10*a* and they are fitted in the valve chambers A, A respectively. Thus, the solenoid valve main body 1 on the left is put to a normally open state, while the solenoid valve main body 2 on the right is put to a normally closed state in the drawing. Inner valve seats 17, 17*a* are disposed at the ends of the respective valve chambers A, A on the opposite side of the valve seats 10, 10*a*. The inner valve seats 17, 17*a* are fitted to center posts 18, 18*a* and the springs 16, 16*a* are disposed between the center posts and the outer circumference of the inner valve seats respectively. The center posts 18, 18*a* are fitted to the inner ends of the bobbins 15, 15*a* and plate uppers 19, 19*a* are disposed to the outer end of the bobbins 15, 15*a*. Housings 20, 20*a* are fitted to the outer circumference of the plate uppers 19, 19*a* and the center posts 18, 18*a*, and solenoids 21, 21*a* are contained between the housings 20, 20*a* and the bobbins 15, 15*a*. The plungers 11, 11*a*, the housings 20, 20*a*, the center posts 18, 18*a*, etc. are made of martensite type stainless steels and like other magnetic materials and, when the solenoids are energized, the plungers 11, 11*a* are attracted in the direction of the center posts 18, 18*a* respectively. That is, when the solenoid 21 of the vacuum generating solenoid valve main body 1 is energized, the plunger 11 moves rightwardly against the spring 16, by which the valve head 12 abuts against the inner valve seat 17 and closes the valve hole to stop the flow out of pressurized air. While on the other hand, when the solenoid 21*a* of the vacuum cancelling solenoid valve main body 2 is energized, the plunger 11*a* moves leftwardly against the spring 16*a*, by which the valve head 12*a* departs from the valve head 10*a* and opens the valve hole. While the other end of the plunger abuts against the inner valve seat 17*a*, since the path 14*a* communicates the valve hole with the valve chamber A, pressurized air enters from the valve hole of the valve seat 10*a* on the inlet side and flows out from the valve hole of the inner valve seat 17*a* on the exit side. When the respective solenoids are deenergized, the valve main body 1 on the left is opened (normally opened) while the solenoid valve main body 2 on the right is closed (normally closed) by the action of the springs 16, 16*a* as shown in the drawing. Power source supply terminals 22, 22*a*, connection holes 23, 23*a*, etc. are disposed on the upper surface of the solenoid valve main body. Lighting portion such as of LED devices 24, 24*a* are disposed so as to light up upon energization and LED lenses 25, 25*a* made of acryl resin or the like are disposed to the outside thereof.

Manually operated buttons 26, 26*a* are disposed to the outside of the solenoid valve main bodies 1, 2. The manually operated buttons 26, 26*a* have enlarged diameter portions 27, 27*a* formed to the inside thereof while being situated in the inflow chambers 9, 9*a* and operation levers 28, 28*a* formed to the further inside of the enlarged diameter portions that extend through the valve holes of the valve seats 10, 10*a* toward the plungers 11, 11*a* respectively. The top end of the operation lever 28 of the vacuum generating solenoid valve main body 1 is opposed to the bottom of the path 14 of the plunger 11, while the top end of the operation lever 28*a* of the vacuum cancelling solenoid valve main body 2 is inserted through a small hole 29*a* formed to the valve head 12*a* and opposed to the bottom thereof. Then, when the manually operated buttons 26, 26*a* are pressed, each of the plungers 11, 11*a* can be moved rightwardly or leftwardly to turn ON or OFF each of the solenoid valves in the same manner as energizing each of the solenoids 21, 21*a*. When the pressing is stopped, pressurized air acts on the enlarged diameter portions 27, 27*a* to return each of the manually operated buttons 26, 26*a* leftwardly or rightwardly into the state shown in the drawing. Thus the solenoid valve can be operated manually in case of emergency or when the plunger is not operable by the solenoid.

Figure 5:
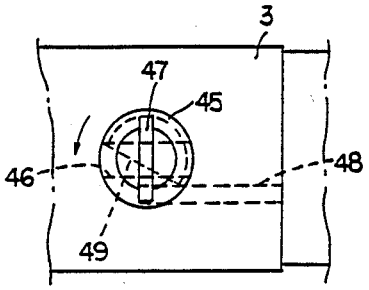
FIG. 5 and FIG. 6 are plan views illustrating the operation of a vacuum cancelling and flow rate regulating valve.
Figure 6:
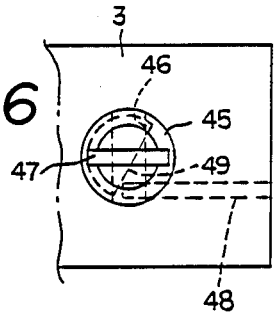

In the pump main body 3, as shown in FIG. 2, an ejector block 31 having an ejector hole 30 to the hollow portion bored in the longitudinal direction thereof and a nozzle block 33 having a nozzle 32 corresponding to the ejector hole 30 are fitted, the nozzle block 33 is corresponded to the inner valve seat 17 of the vacuum generating solenoid valve main body 1 and a suction chamber 34 is formed between the nozzle hole 32 and the ejector hole 30. A resilient conical vacuum holding check valve 35 made of rubber of synthetic resin fitted to the ejector block 31 is disposed on the side of the suction chamber 34 and the suction chamber 34 is in communication with pass holes 36, 37 by way of the check valve 35. In the drawing, the lower pass hole 37 is in communication with the suction port 38 by way of the filter main body 4, while the upper pass hole 36 is in communication with the inlet 7 of the pressurized air by way of the pass hole 8*a* of the vacuum cancelling solenoid valve main body 2. A seal valve 39 is disposed oppositing to the exit end of the ejector hole 30, the seal valve 39 has a resilient valve head 40 and the cylindrical portion of the valve is slidably mounted to a mounting member 41 fitted to the through-hole of the pump main body 3, so that it can move to a position for closing the open end of the ejector hole 30. The cylindrical portion on the right of the seal valve 39 in the drawing is in communication with the pass hole 8*a* by way of the valve seat 10*a* of the vacuum cancelling solenoid main body 2. Since the cross sectional area of the cylindrical portion is made greater than the opening area of the open end of the ejector hole 30, if the pressurized air is introduced to the right of the seal valve 39 in the drawing by actuating the vacuum cancelling solenoid valve 2, the seal valve 39 displaces toward the ejector hole 30, while overcoming the pressurized air jetted out through the check valve 35 and the ejector hole 30 thereby closing the exit end of the ejector hole. While on the other hand, if the pressurized air is supplied only from the ejector hole 30 by the actuation of the pump main body 1, the seal valve 39 is displaced in the direction aparting from the exit end of the ejector hole. Since a pressure-reduced state is formed from the pass hole 36 to the valve chamber A of the solenoid valve 2, the seal valve 39 is displaced in the direction aparting from the exit end of the ejector hole also by this state. A pass hole 43 in communication with an exhaust port 42 is disposed at the exit end of the ejector hole 30. Further, a pass hole 44 is formed about at the center for communicating the inlet 7 of the pressurized air with the pass holes 8, 8*a* of the solenoid valve main bodies 1, 2. A control valve 45 for the flow rate of vacuum cancelling pressurized air is disposed to the upper pass hole 36 of the pump main body 3. The control valve 45 has a control hole 46 capable of communication with the pass hole 36, has an engaging groove 47 formed at the upper surface thereof and is prevented from slipping off by a pin 48 inserted from the side. A recess 49 is formed at the circumferential side corresponding to the pin 48 and, by inserting a driver or like other suitable member to the engaging groove 47 it can be rotated till the both ends of the recess 49 abuts against the pin 48 in a state where the control hole 46 is in communication with the pass hole 36 shown in FIG. 2 and FIG. 5, and a state where the control hole 46 is in perpendicular to the hole 36 and thus out of alignment therewith (FIG. 6).

Figure 7:
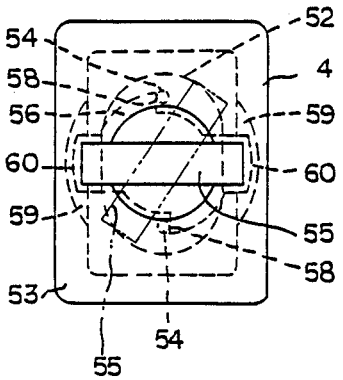
FIG. 7 is a side elevational view for a filter main body.

The filter main body 4 has a pass hole 50 in communication with the pass hole 37 and a pass hole 51 in communication with the suction port 38, and a cylindrical filter 52 is disposed between the pass hole 50 and the pass hole 51. The filter 52 is made of polypropylene powder which is sintered so as to have an appropriate air permeability, but it may be formed with other appropriate material. One end of the filter is supported on the attaching pins 54, 54 disposed to a cover 53 fitted on the left in the drawing. A lock knob 55 is fitted to the cover 53 and a lock plate 56 is secured by means of a snap ring 57 to the inner side of the knob 55. As shown in FIG. 7, the lock plate 56 has engaging edges 58, 58 for engaging the pins 54, 54 and engaging fingers 60, 60 for engaging the engaging grooves 59, 59 formed to the inside of the main body 4. Then, when the lock knob 55 is rotated to a position shown by the chained line in FIG. 7, the engaging fingers 60, 60 of the lock plate 56 are detached from the engaging grooves 59, 59, by which the cover 53 and the filter 52 can be detached from the filter main body 4, so that the filter 52 can be taken out appropriately for cleaning, replacement, etc. When the lock knob is returned to the position shown by the solid line in the drawing after the mounting of the filter, it can be attached again to the position shown by the solid line in the drawing by returning the lock knob. The filter main body 4 is formed with a transparent synthetic resin material such as polycarbonate so that the contaminations of the filter 52 can be seen through.

The vacuum switch 5 is in communication with the suction port 38 and the flow channel 61 and, as is well-known, turns ON or OFF a switch so as to control the vacuum generating solenoid valve main body 1 depending on the degree of vacuum actuated on the suction port 38.

The lower surface of the pump main body 3 is secured by way of a base plate 62, a gasket 63 and a truck mount sub-base 64 to a mounting truck 65 (FIG. 1). An inlet pipe 66 in communication with the inlet 7 of the pressurized air for the pump main body 3 and an exhaust pipe 67 in communication with the exhaust port 42 are penetrated through the side of the sub-base 64, and a suction pipe 68 in communication with the suction port 38 is disposed on every sub-base to the end face thereof. A conduit 69 of a vacuum catching device is connected to the suction pipe 68 and the top end of the conduit 69 is connected to a suction box 70. The conduit 66 and the exhaust pipe 67 are in communication with each other when a plurality of the sub-bases 64 are dispoed in adjacent with each other on the mounting truck 65 so that it can provide an introduction port and an exhaust port in common with each of the units.

Figure 8:
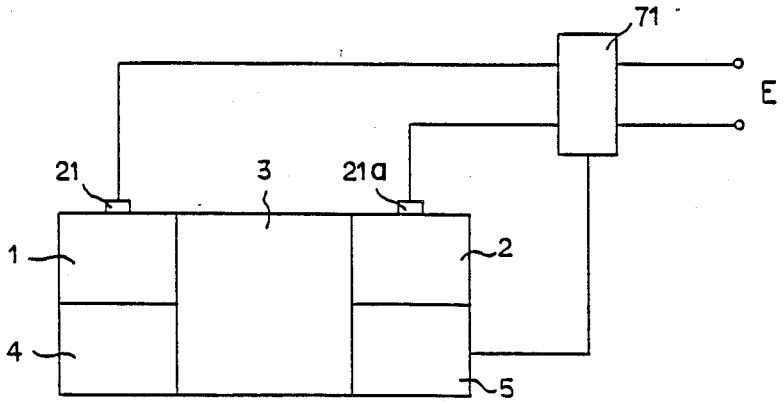
FIG. 8 is a circuit diagram.

Then, the solenoids 21, 21*a* of the respective solenoid valve main bodies 1, 2 and the vacuum switch 5 are connected to a control device 71 respectively as shown in FIG. 8 and they operate as described below. In the drawing, E represents a power source.

Figure 9:
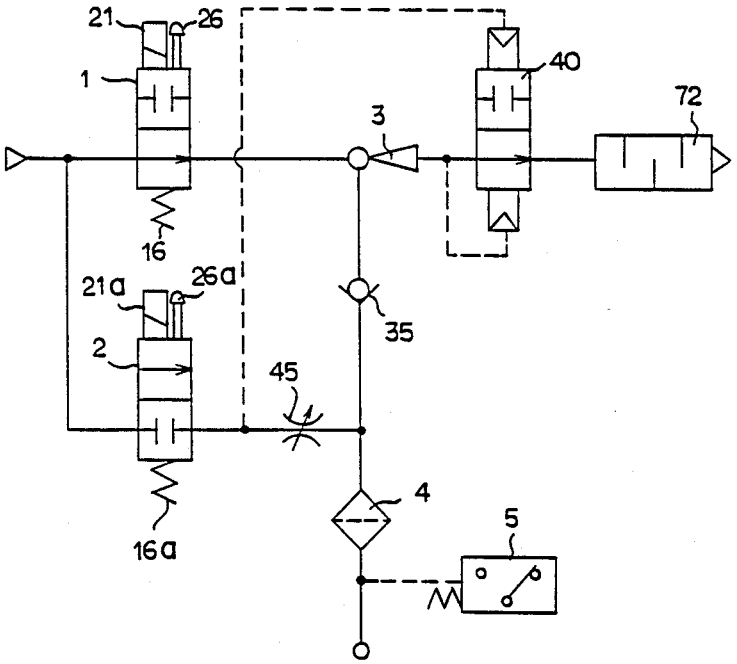
FIG. 9 is a pneumatic pressure circuit diagram.

Referring to FIG. 9 which is a pneumatic pressure circuit diagram and FIG. 2, the inner valve seat 17 of the vacuum generating solenoid valve main body 1 is opened in the illustrated state, the surface of the plunger 11 formed with the path 14 abuts against the valve seat 10 and the valve hole of the valve seat 10 is in communication with the valve chamber A by way of the path 14. Accordingly, the pressurized air is sent through the inlet pipe 66, inlet 7, pass holes 44, 8 and the inflow chamber 9 and then by way of the long groove 13 of the plunger 11 and the inner valve seat 17 and then jetted out from the nozzle hole 32 to the inside of the ejector hole 30, attracts and exhausts the air in the suction chamber 34, passes by way of the exhaust port 42 and through the exhaust pipe 67 (FIG. 1) and is then discharged into the atmosphere. Further, a silencer 72 may optionally be disposed to the top end of the exhaust pipe 67 (FIG. 9). The pass holes 37, 50 in communication with the suction chamber 34, the filter 52 and the system in communication with the suction port 38 are evacuated by the attraction and exhaustion as described above and the pressure at the inside of the suction box 70 is reduced by way of the suction pipe 68 and the conduit 69, by which it is possible to attract articles 73 and transport them to a required position. When the pressure in the vacuum system reaches a predetermined negative pressure, since the vacuum switch 5 is actuated to energize the solenoid 21 of the vacuum generating solenoid valve main body 1, the plunger 11 moves rightwardly toward the centerpost 18 against the spring 16, while the valve head 12 abuts against the inner valve seat to close the valve hole and also stops the supply of the pressurized air to the nozzle hole 32. However, the inside of the system is maintained to a predetermined negative pressure by the check valve 35. When the degree of vacuum is reduced by means of air leak, etc., the vacuum switch 5 detects this to release the energization for the solenoid 21, opens the inner valve seat 17 to supply the pressurized air again in the nozzle hole, and actuates the pump to increase the desired vacuum degree in the system.

After transporting the articles 73, when each of the solenoids 21, 21*a* of the solenoid valve main bodies 1, 2 is energized by the control device 71, the plunger 11 of the vacuum generating solenoid valve main body 1 moves rightwardly to close the inner valve seat 17 as described above to interrupt the supply of the pressurized air into the nozzle hole 32. While on the other hand, since the plunger 11*a* of the vacuum cancelling solenoid main body 2 moves leftwardly and the valve head 12*a* aparts from the valve seat 10*a* to open the valve hole, pressurized air is supplied by way of the pass holes 44, 8*a*, 36, 37, 50, 51, etc. to the suction port 38 and the negative pressure of the suction box 70 can rapidly be eliminated. In this case, since the seal valve 39 moves leftwardly to close the exit end of the ejector hole 30, loss of the pressurized air for vacuum cancellation can be prevented. The time and the amount for supplying the pressurized air can be controlled by the control device 71 and the flow rate control valve 45. When each of the solenoids 21, 21*a* is deenergized, the plungers 11, 11*a* are respectively returned by the springs 16, 16*a* to the state shown in the drawing and can again attract articles. It is also possible to apply operation by the manually operated buttons 26, 26*a* without using the solenoid.

The present invention has been constituted as described above in which a normally open or normally closed type valve device can be obtained simply by merely changing the direction of inserting plungers in the valve chamber which is convenient and economically advantageous. The solenoid on-off valve according to the present invention can also be utilized to a hydraulic circuit or the like.

What is claimed is:

1. In an electric solenoid on-off valve for opening and closing a flow channel passing through the solenoid plunger chamber (A) of said valve by moving a solenoid plunger (11) alternately against first and second ported valve seats (10, 17) positioned at the opposite ends of said chamber, in which each of said valve seats is provided with a valve hole therethrough, and which a plunger return spring (16) is disposed in said chamber for returning said plunger against one of said valve seats, the improvement comprising:

a valve head (12) formed on one end of said plunger for closing the port in one of said seats, means on the other end of said plunger defining a groove (14) forming a path for communicating the valve hole in the other said valve seat with said chamber, said plunger adapted to be reversibly received in said chamber by turning end-for-end so that said flow channel through said valve is either normally open or normally closed depending upon the orientation of said plunger, and a manually operated push button (26) disposed in said valve and having an operating lever (28) extending through the valve hole in said one valve seat into the interior of said chamber for engagement with said plunger therein and operable upon pressing to move said plunger against said return spring.

* * * * *